US005468203A

United States Patent [19]

Okonkwo

[11] Patent Number: 5,468,203

[45] Date of Patent: Nov. 21, 1995

[54] WEIGHT LIFTING SAFETY DEVICE

[76] Inventor: Charles U. Okonkwo, P.O. Box 25226, Tempe, Ariz. 85282

[21] Appl. No.: 283,606

[22] Filed: Aug. 1, 1994

[51] Int. Cl.[6] ..... A63B 21/078

[52] U.S. Cl. ..... 482/104; 248/125.2; 482/4

[58] Field of Search ..... 482/1, 4, 92–94, 482/104, 106, 108, 148; 248/125, 132, 161

[56] References Cited

U.S. PATENT DOCUMENTS 4,799,674 1/1989 Ochab ..... 482/104
5,257,964 11/1993 Petters ..... 482/104 X

FOREIGN PATENT DOCUMENTS 3300073 7/1984 Germany ..... 482/98

*Primary Examiner*—Richard J. Apley
*Assistant Examiner*—John Mulcahy
*Attorney, Agent, or Firm*—Gregory J. Nelson

[57] ABSTRACT

A safety device for weight lifters having a pair of stands attachable at a collar at opposite ends of a barbell. The stands have telescopic members releasable in the event a lifter is in trouble. The stands descend to the surface to stabilize the barbell and remove the weight from the lifter. The release is controlled by a switch or tilt sensor which activates a solenoid operator. Stops are provided to limit the relative travel of the telescopic members.

10 Claims, 2 Drawing Sheets

WEIGHT LIFTING SAFETY DEVICE

FIELD OF THE INVENTION

The present invention relates to an exercise device and more particularly relates to a safety device for use in power-lift exercising, particularly when performing lifts of the type known as "squat lifts".

One particular type of power lifting is known as the squat lift. In squat exercising, the barbell, which may carry in excess of 1,000 pounds of weight, is supported on a rack or stand which positions the bar slightly below the shoulder height of the individual. The individual then bends slightly forward and backs beneath the bar grasping it with both hands. Thereafter the lifter steps forward from the rack after having lifted the barbell clear of the rack. The lifter then squats until the lifter's thighs are positioned parallel to the floor. The bar is supported by the weightlifter's shoulders and the hands which are positioned behind the weightlifter's head. If the lifter is unable to make the lift, the lifter may not safely drop the barbell due to its position resting on the lifter's shoulders which places the lifter in jeopardy in such a situation.

As a result of the inherent dangers involved in squat lifting, it has been traditional for a lifter in training to work with heavy weights in association with assistants, known as "spotters" who steady the bar and return it to the stand if the lifter is unable to do so. Weight training in this way is not convenient as spotters are not always available. A lifter training with heavy weights is restricted in his or her activities or must risk injury in the event the lifter is not able to make the lift.

DESCRIPTION OF THE RELATED ART

Because of these dangers and problems attendant to power-lift training, various safety devices for assisting a lifter have been developed.

U.S. Pat. No. 4,249,726 discloses a bench press safety device which in one embodiment utilizes an electromechanical jack to catch the barbell in the event of a failed lift.

U.S. Pat. No. 4,262,901 shows a weight lifting device having a flame which has vertically adjustable main support arms which receive the weight prior to lifting. The flame also includes adjustable side flames which provide auxiliary safety support for barbells should the individual be unable to return the weights to the main support arms following lifting. Should the exerciser, when in a lowered or squat position, be unable to rise with the barbell, the lifter lowers his or her body until the weight of the barbell is taken up by the horizontal side frames.

U.S. Pat. No. 4,324,398 shows a weight lifting device for use in bench press and/or squat lifting exercises which has a flame with a pair of cables. Stops are provided on the cable and the frame which serves to limit the extension of the cable which is attached by a clamp to a barbell.

U.S. Pat. No. 4,420,154 shows a weight lifting apparatus having a framework with slidable adjustment members positioned on the frame. The weight rests on the slidable members in the frame.

U.S. Pat. No. 4,249,726 discloses a safety device for use with bench press exercises having a pair of arms controllable by the exerciser which may be engaged with the barbell to raise it clear of the exerciser in the event the exerciser is unable to raise the barbell.

U.S. Pat. No. 4,709,922 shows a barbell support apparatus which has an overhead pulley that supports and guides a support cable. The cable is attached at both ends to a barbell. The pulley is suspended from a suspension system and provides for height adjustment of the barbell. The cable has stops which limit the range of movement of the support cable in either direction, thereby preventing the suspended weight lifting barbell from tilting excessively away from the horizontal starting position when performing bench press or squat repetition exercises.

U.S. Pat. No. 4,799,672 utilizes hydraulic cylinders and spaced-apart vertical support members which operate synchronously and which receive the ends of a barbell through support members.

Thus, while the prior art discloses various safety devices to assist a person in weight training, such devices have not found wide acceptance in practice. There are a number of reasons for lack of general acceptance of prior art devices including the expense of such devices, the complexity of such devices and inability of such devices to adjust to the needs and requirements of the individual when training.

SUMMARY OF THE INVENTION

The present invention addresses the needs of the power lifter, particularly those lifters engaged in squats. The present invention provides a simple and effective safety device which meets the needs of the lifter and which device is carried on the barbell. The device can be automatically activated or activated by the user to release support members which will drop to the surface to stabilize the barbell and remove the weight from the lifter, reducing the possibility of injury to the lifter.

Briefly, in accordance with the present invention, the safety device of the present invention comprises a pair of support stands. Each of the stands has a base and a vertically extending upright which has a plurality of vertically extending teeth which form part of a ratchet mechanism. The upright is telescopically slidable with respect to an outer tube. An electrical solenoid is mounted on the outer tube and has a plunger which carries a detent engageable in the teeth in the upright member. The solenoid is normally spring-biased inwardly into engagement with the teeth of the upright. When actuated by the user, the plunger of the solenoid retracts sufficiently to disengage permitting the upright to drop downwardly until the base at the lower end of the upright engages the surface to stabilize the barbell.

The barbell is attached to a bracket at the upper end of the outer tube. The bracket includes a collar which rotatably engages an inner sleeve secured at the end of the barbell. The ratchet mechanism includes a pawl that will not allow the upright to be released until the solenoid is actuated. Similarly, a stop is provided on one of the telescoping members to limit the distance which the support stand can drop when actuated.

The solenoids associated with each stand are simultaneously actuated by the user from a switch which may be secured to the barbell at a convenient location. If, for example, the lifter becomes unbalanced or is unable to complete the lift, the lifter can manually actuate the solenoids with a thumb or finger to cause the uprights to drop to the floor to support the opposite ends of the barbell.

Similarly, if the lifter is in the squatting position and unable to complete the lift, the supports enable the lifter to lower the supports to the surface and extricate himself or herself from beneath the barbell avoiding possible injury.

The solenoids may be operable from standard electrical current or may be battery operated. A tilt switch will automatically energize the solenoids if one of the stands is tilted beyond a predetermined angle from the vertical.

Accordingly, it is a primary object of the present invention to provide a safety device for use with barbells, especially designed for squat power lift exercising.

It is another object of the present invention to provide a pair of support stands which are attachable to the opposite ends of the barbells and which may be released by the user to drop to the floor or supporting surface to stabilize the barbell.

BRIEF DESCRIPTION OF THE DRAWINGS

The above and other objects and advantages of the present invention will become more readily apparent from the following detailed description taken in conjunction with the claims and accompanying drawings in which:

Figure 1:
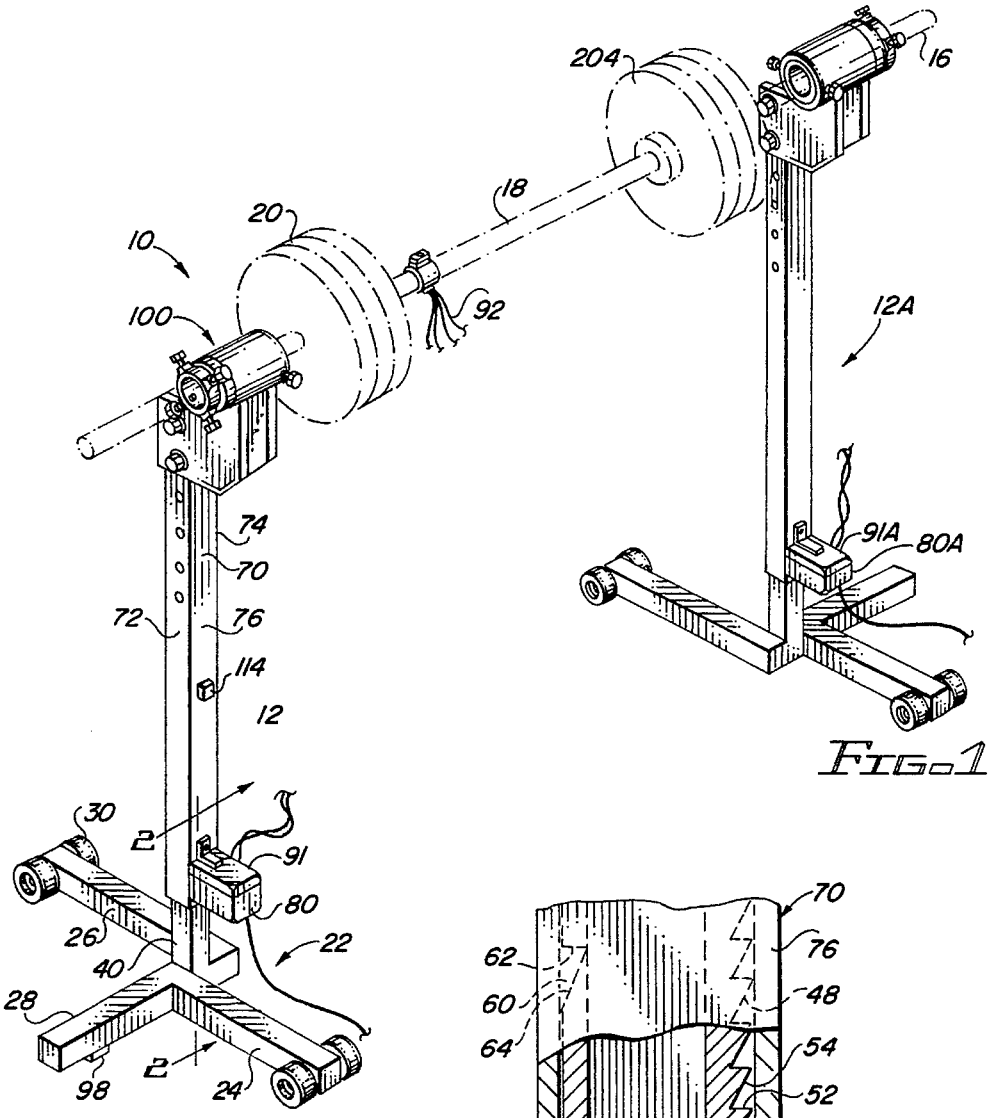
FIG. 1 is a perspective view of the safety device of the present invention shown in conjunction with a barbell which barbell is represented in dotted lines.
Figure 3:
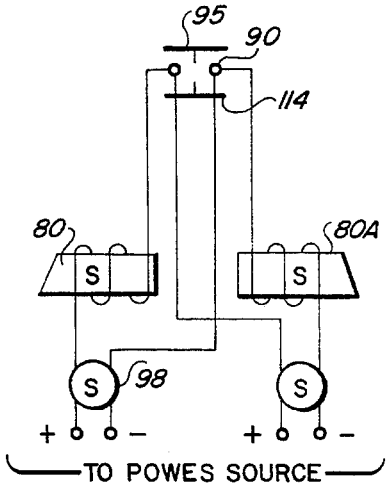
FIG. 3 is a schematic of the electrical system of the device of the present invention.

Referring now to the drawings, the safety device of the present invention is generally designated by the numeral 10 and includes a pair of oppositely disposed support stands 12 and 12A. The support stands 12, 12A are identically constructed and are positioned at opposite ends of a barbell 16 having a horizontal bar 18 and a plurality of removable weights 20 and 20A. Bar 18 projects through collars on the weights 20, 20A extending outwardly providing a location for attachment of the support stands 12, 12A at the ends of the bar.

Each of the support stands includes a base 22 which may be a platform but is shown having forwardly extending foot member 24, rearwardly extending member foot 26 and outwardly extending foot member 28. Optional rollers 30 may be provided at the distal ends of members 24 and 26 to facilitate movement of the stands. This configuration of the base is preferred as it provides only minimal projection into the area between the stands 12 and 12A so as not to interfere with the area occupied by the weight lifter. The base 22 is preferably formed as a integral unit and the members 24, 26 and 28 may be solid bars or tubular steel members suitably welded together.

Since stands 12 and 12A are identical, the detailed description of stand 12 will be understood to also apply to stand 12A. Upright 40 extends vertically from the base member and is shown secured near the inner end of member 28. The term "inner" as used herein refers to the side of the stands disposed towards the weightlifter and "outer" refers to the side away from the area occupied by the weightlifter. The upright 40 may be welded to the base or may be secured to the base by a suitable bracket.

Figure 2:
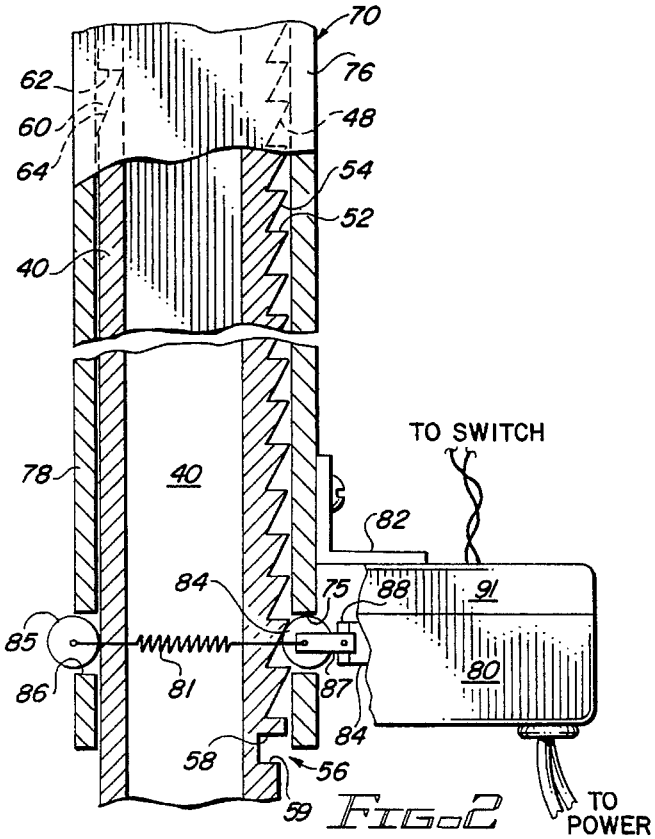
FIG. 2 is a sectional view taken along line 2—2 of FIG. 1.
Figure 4:
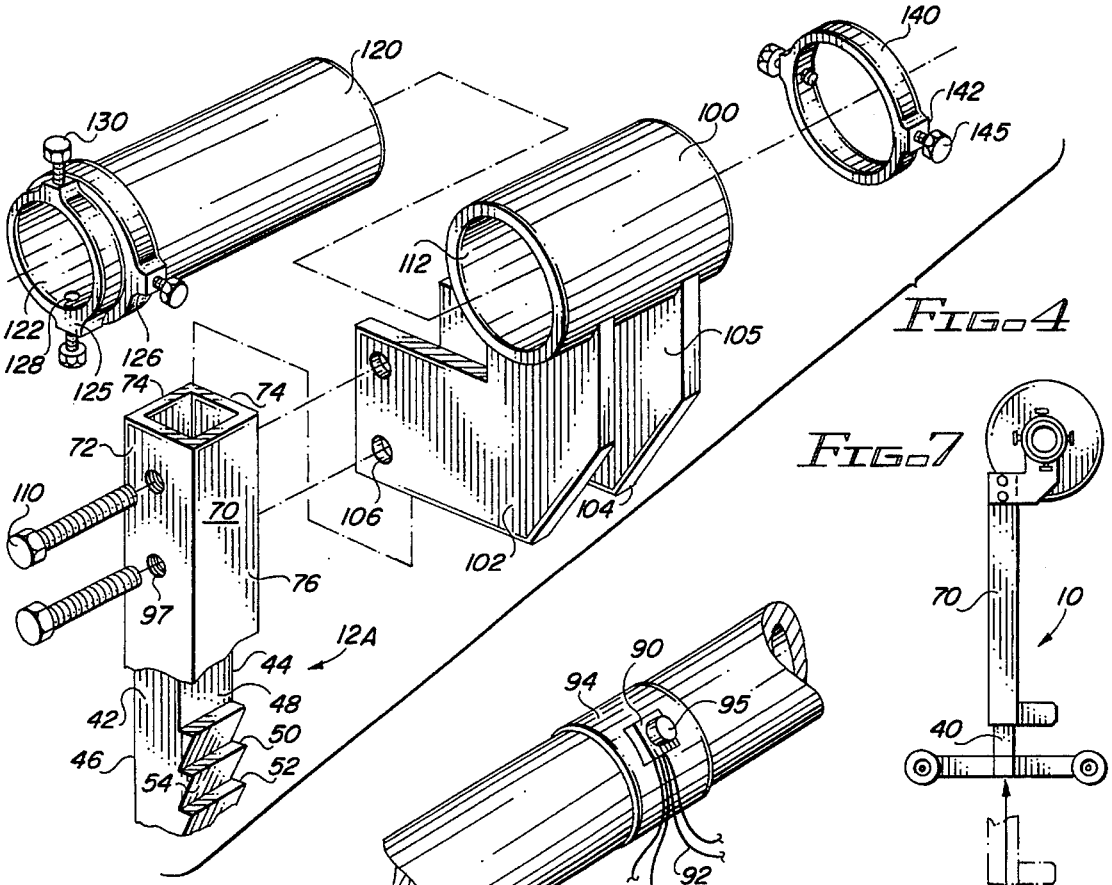
FIG. 4 is an exploded detail view of the upper end of the safety device.

The uprights are fabricated from a suitable material such as a steel section which is generally square in cross section having opposite sides 42, 44, front 46 and rear 48. The height of the upright may be any suitable dimension but for most lifting applications the upright would extend upwardly approximately between 36" to 60". Rear side 48 of the upright is provided with a series of spaced-apart ratchet teeth 50 beginning at an elevation spaced above the base. Each of the teeth 50 has a profile having a horizontal surface 52 and angular surface 54 which extends upwardly at an acute angle with respect to surface 52. A notch 56 is provided in rear 48 of the upright immediately below the lower-most tooth. The notch 56, as shown in FIG. 2, has a generally square cross section having oppositely disposed horizontal surfaces 58 and 59.

Another notch 60 is provided in side 46 of the upright disposed below the upper end of the upright. The notch 60 has a horizontal surface 62 and a downwardly inclined surface 64 which forms an acute angle with respect to surface 62. The notch 60, as will be explained, provides a stop to prevent the upright from disengaging from the tube 70. The upright 40 and the tube 70 are in telescopic relationship and slidable relative to one another.

Tube 70 is shown as being square in cross section having opposite outer and inner side walls 72, 74, front side 76 and rear side 78. The upper end of the tube 70 is open so that the upright may extend beyond the upper end of the tube.

An electric solenoid operator 80 is secured to the rear wall 76 of the tube at a location near the lower end of the tube. The solenoid 80 may be secured to the tube by suitable L-bracket 82. Solenoid 80 carries a plunger 84 which is normally biased outwardly or in the extended position. An aperture 75 is provided in wall 76 aligned with the plunger of the solenoid. The outer end of the plunger carries a bar 88 connected to detent 84 by a link 87. The detent is shown in the form of a cylindrical roller extending transversely of the axis of the solenoid plunger. In the normal unactuated position as shown in FIG. 2, the detent 84 assumes a position engaging one of the teeth 50 securing the tube and upright against relative movement.

A slot 86 extends transversely in the rear wall 78 of the tube opposite the solenoid plunger. The opposite ends of a keeper 85 are attached by spring 81 extending along opposite sides of the tube between the link 87 and the keeper. Accordingly, it will be seen that when the upright 40 moves downwardly within the tube 70 from the position in FIG. 2 to a position in which the detent notch 60 is aligned with keeper 85, the keeper 85 will engage the surface 62 of the notch preventing further downward movement of the upright and disengagement of the upright from the outer tube.

Figure 6:
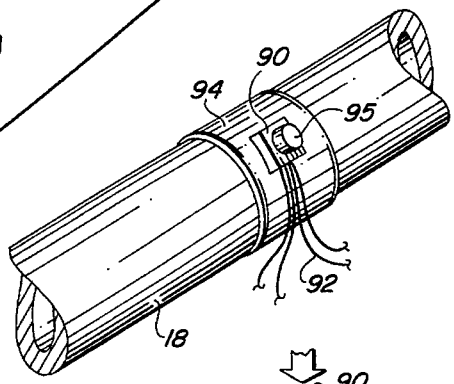
FIG. 6 is a detail perspective view of a section of the barbell showing the actuator switch secured thereto.
Figure 7:
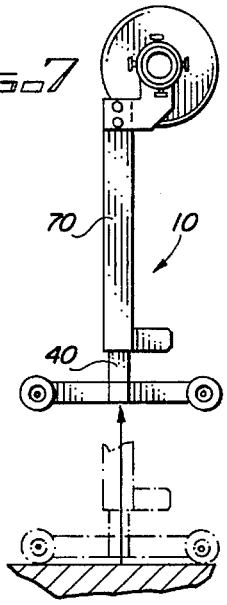
FIG. 7 is a side view of one of the stands of the safety device shown in an elevated position attached to the barbell.
Figure 5:
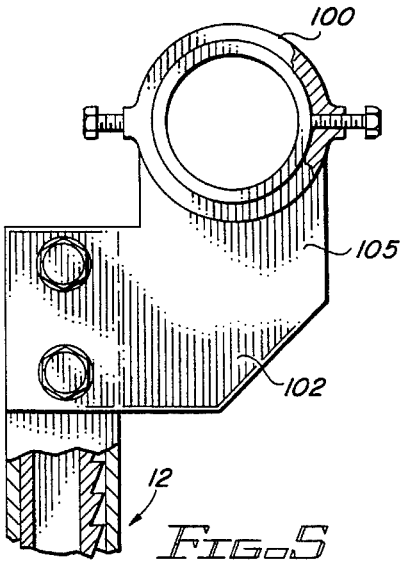
FIG. 5 is a side view of the upper end of one of the stands of the safety device of the present invention.

The operation of the device is controlled by the solenoid 80 which is connected to a suitable power source and energized by switch 90. The power source may be a standard 110V source or alternatively may be a battery contained within a housing 91 mounted adjacent the solenoid as shown in FIG. 1 having a lower power LED indicator. The power source is switched on manually or by a switch 98 on base 22 which closes when the device is lifted. Switch 90 is connected to the solenoid by means of conductors 92. Switch 90 is preferably located at a convenient location which permits the switch to be quickly accessed by the user by depressing button 95. As shown in FIG. 6, switch 90 may be mounted on an arcuate clip member 94 which may be of plastic or other flexible material to allow the clip 94 to be engaged about the bar 18 of the barbell. The clip and attached switch may be axially moved to any convenient location adjacent the hand of the user so the switch can be quickly depressed in case of an emergency. When the switch is depressed, the solenoids 80 and 80A are energized causing the associated plungers and detents to retract. As the detents retract, the uprights 40 will be released to move downwardly a distance until the base 22 engages the floor or supporting surface or until the keeper 85 engages the slot 60 in the upright in each of the stands.

A mercury switch 114 is shown mounted on stand 12. The mercury switch is set to close at a predetermined deviation from vertical energizing the solenoids to release the uprights in case the lifter excessively sways or tilts.

As indicated above, the support stands 12 and 12A of the safety device are attached to the barbell device at opposite ends of the bar. The attachment is accomplished by means of a cylindrical collar 100 carried on a pair of L-shaped brackets 102 and 104. The brackets 102, 104 each have a horizontally extending offset 105 which attaches to the upper end of the associated tube 70 positioning the collar so that the horizontal axis of the collar is offset from the vertical axis of the tube.

Bracket 102 has a pair of vertically aligned bores 106 which register with threaded bores 97 in the upper end of the tube. A pair of bolts 110 extend through the brackets into threaded engagement with bores 97. The length of the bolts is selected so as not to extend inwardly a distance to interfere with the normal sliding operation of the upright.

Cylindrical sleeve 120 has an internal bore 122 which is engageable about the ends of the bar 18. The outer diameter of the sleeve 120 is rotatable within the collar 100. The outer end of the sleeve 120 is provided with a plurality of circumferentially spaced bosses 125, 126. The bosses each define an internally threaded bore 128 which are adapted to receive bolts 130 spaced at locations approximately 90° from one another.

A retaining collar 140 is adapted to be positioned about the inner end of sleeve 120. Retainer 140 has oppositely disposed bosses 142 each of which defines an internally threaded bore which receives a bolt 145.

In use, the safety device of the present invention is secured to a barbell 18 having the desired weights 20 and 20A positioned thereon. The sleeves 120 associated with each of the support stands 12 and 12A are positioned on opposite ends of the barbell 18. This is accomplished by first positioning the retainer ring 140 on the opposite ends of the bar. The ends of the bar are then inserted through the axial bores in the collars 100 on the upper end of the opposite stands. The inner sleeves 120 are then slipped over the ends of the bars and through the respective collars 100 associated with each of the stands. The retainer rings 140 are then moved into position engaged on the inner end of sleeves 120 and abutting the inner end of the fixed collars 100. The respective bolts 130 and 145 are then tightened into locking engagement with the barbell and collar securing the barbell to the stands.

The actuator switch 90 is positioned at a suitable selected location along the bar by engaging the clip 94 on the barbell. Preferably, the actuator switch is positioned adjacent the hand position on the barbell so the switch key or button 95 may be quickly actuated by the thumb of the user in case of emergency. The lifter then assumes the position beneath the bar and actuates the actuator switch 90 to disengage the plunger and detent 84 to allow the outer tube 70 to lower to the appropriate starting position with the detent in slot 56. In the case of a squat lift, the lifter is initially positioned with the bar slightly below shoulder height of the weight lifter. The lifter, with back slightly bent, will back under the bar and then grasp it with both hands and stand erect lifting the bar slightly and the attached stands. Raising the base will energize the system by means of switch 98. The attached stands are of predetermined weight which is added to the total weight of the barbells and the weights 20 and 20A. The lifter then continues with the lift which involves the lifter doing a deep knee bend or squat with the bar supported by his or her hands and on the shoulders behind the head of the lifter. If the lifter, when in a lowered, squat position, is unable to stand to an upright position with the barbell pressing down on his shoulders, the lifter merely lowers himself or herself to a position in which the base of the stand engages the supporting surface which will remove the weight from the shoulders allowing the lifter to be free of the weight.

Figure 8:
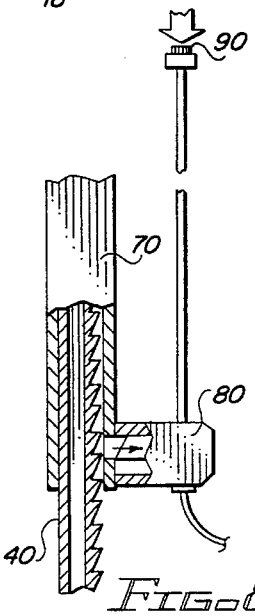
FIG. 8 is a detail view, partly in section, illustrating the actuation of the solenoid initiating the release of the upright.
Figure 9:
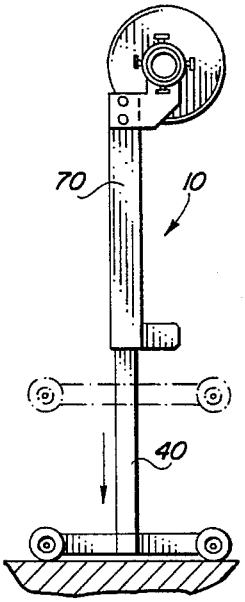
FIG. 9 is a view similar to FIG. 7 showing the upright of the stand in a released position engaging the supporting surface stabilizing the barbell.

On the other hand, if the lifter is in an erect or semi-erect position and is unable to complete the lift or becomes unstable and the barbell tilts to an extreme position (15° to 20° ), the lifter may depress the actuator switch which will energize the solenoids 80. Excessive tilt will also cause automatic actuation by means of tilt switch 110. The energization of the solenoids will cause the associated plungers to retract withdrawing the detents from the engagement with the associated uprights as shown in FIG. 8. This will allow the uprights to drop downwardly due to gravity until the base 24 strikes the floor or supporting surface. This is shown in FIG. 9. When this occurs, the solenoid plungers which are biased inwardly into engagement with the upright will move into engagement with the aligned tooth 50 providing a solid stand support for the weight at either end stabilizing the weight. In the event the upright should be allowed to drop at substantially its entire length, the groove 60 will be engaged by the keeper 86 to prevent the upright from becoming fully disengaged from the tube 70. In the lowermost or starting position of the stands, the plunger is engaged in the lowermost slot 56 of the upright which will not allow the upright to move or ratchet downwardly until the solenoid is fully actuated. This allows the stand to be lifted with the barbell. Also, an advantage is that some tilt while lifting may occur and upon release the stands, under the influence of gravity, will descend straight downwardly.

While the weight lifting safety device of the present invention has been described with reference to squat exercises, the device has application to other types of exercises such as the bench press. An important feature of the invention is that it is versatile and allows the lifter freedom of range of movement. The safety device does not interfere with the normal lifting procedures and the stands when carried on the ends of the bar rotate freely about the sleeve and collar arrangement so as to always assume a generally vertical position. As indicated above, the weight of the stands will be added to the total weight of the bar. The device while useful in competition, is intended for primary use in exercising and training, eliminating the need for spotters to assist the lifter. The upright, while shown as square, may be round in cross section. Also, friction locking means may replace the ratchet arrangement.

Accordingly, while the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. A weight lifting safety device attachable to a barbell having a bar, said device comprising:

(a) a pair of spaced-apart, substantially vertical support members, each of said support members having:
  (i) a base;
  (ii) an upper tube member;
  (iii) bracket means on said tube attachable to the end of said bar;
  (iv) an upright member slidable with respect to said tube member and having a base at the lower end;
  (v) locking means for selectively securing said upright member to said tube member at selected positions; and (b) actuation means for selectively releasing said locking means whereby the weight lifter can lift the barbell and said stands and may selectively actuate said actuation means to cause said uprights to descend by gravity to engage a supporting surface and stabilize the barbell.

2. The safety device of claim 1 wherein said bracket means includes a cylindrical collar and a cylindrical sleeve rotatable within said collar, said sleeve having fastener means for securing said sleeve to the bar.

3. The safety device of claim 2 wherein said collar and sleeve are offset from the axis of said tube.

4. The safety device of claim 1 wherein said upright includes a plurality of ratchet teeth and wherein said actuation means includes an electric solenoid having a detent selectively engageable in said ratchet teeth.

5. The safety device of claim 4 further including stop means limiting the relative slidable movement between said tube and upright.

6. The safety device of claim 4 wherein said electric solenoid is connected to a manual switch attachable to the bar.

7. The safety device of claim 4 wherein said solenoid is connected to a battery pack.

8. The safety device of claim 4 wherein said electrical solenoid is connected to a source of power by means of a safety switch which operates to turn the power on when said device is elevated.

9. The safety device of claim 4 further including a tilt switch which operates to energize said solenoid when the device is tilted a predetermined deviation from vertical thereby releasing said locking means.

10. The safety device of claim 1 wherein said tube and upright are tubular steel members.

* * * * *